US006684831B2

(12) United States Patent
Grau

(10) Patent No.: US 6,684,831 B2
(45) Date of Patent: Feb. 3, 2004

(54) ELECTRICALLY ROTATABLE SHAFT

(75) Inventor: Ulrich Grau, Emskirchen (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/128,900

(22) Filed: Apr. 24, 2002

(65) Prior Publication Data

US 2002/0157625 A1 Oct. 31, 2002

(30) Foreign Application Priority Data

Apr. 26, 2001 (DE) ..... 101 20 451

(51) Int. Cl.[7] ..... F01L 1/34

(52) U.S. Cl. ..... 123/90.16; 123/90.2; 123/90.26; 123/90.27; 123/90.31

(58) Field of Search ..... 123/90.16, 90.2, 123/90.26, 90.27, 90.31

(56) References Cited

U.S. PATENT DOCUMENTS 4,187,730 A * 2/1980 Delorme ..... 74/54
4,354,790 A * 10/1982 Karl ..... 29/748
4,539,951 A * 9/1985 Hara et al. ..... 123/90.17
4,949,585 A * 8/1990 Dauvegne et al. ..... 74/89.35
4,974,468 A * 12/1990 Reynolds et al. ..... 74/473.19
5,154,091 A * 10/1992 Bianco ..... 74/424.86
5,937,809 A * 8/1999 Pierik et al. ..... 123/90.16
6,311,659 B1 * 11/2001 Pierik ..... 123/90.24

OTHER PUBLICATIONS

Ulrich Grau, Electrically Rotatable Shaft, US Patent Application, Pub. No. US 2002/0157626 A1, Oct. 31, 2002.*

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

The invention concerns an electrically rotatable shaft, and more particularly, an adjusting shaft (1) of a fully variable mechanical valve train of an internal combustion engine, said shaft comprising an adjusting cam (2). The low-friction and lash-free configuration of a drive required for a rapid and exact functioning of the fully variable mechanical valve train is achieved by the fact that the adjusting shaft (1) is rotated by an actuator (3) that comprises an adjusting lever (4) connected rotationally fast to the adjusting shaft (1), while the free end of the adjusting lever is articulated preferably on the screw nut (10) of a screw-and-nut drive (5) that is driven by an electromotor (6).

9 Claims, 2 Drawing Sheets

ELECTRICALLY ROTATABLE SHAFT

FIELD OF THE INVENTION

The invention concerns an electrically rotatable adjusting shaft of a fully variable mechanical valve train of an internal combustion engine, said shaft comprising an adjusting cam.

BACKGROUND OF THE INVENTION

The advantages of a throttle-free load regulation of Otto engines by means of fully variable inlet valve controls are known. By the omission of throttles, it is possible to exclude throttling losses that otherwise occur over a large range of load conditions of the internal combustion engine. This has a positive effect on fuel consumption and on the engine torque.

In variable mechanical valve trains, the stroke adjustment of the inlet gas exchange valves should be as spontaneous and exact as possible and should be effected at a high speed of adjustment. The adjusting mechanism is usually an adjusting shaft having locking curves or eccentrics.

Depending on the system used and the structural configuration, considerable moments of actuation are required for setting the desired valve stroke and the corresponding rotation of the adjusting shaft. These moments of actuation result from the reaction forces of the valve train that act on the adjusting shaft. For adjustment in a direction for obtaining a larger stroke, the adjusting shaft must be moved against the reaction forces of the valve train and, due to the oscillating movement of the gas exchange valves, this is accompanied by strongly pulsating torques.

To achieve an optimum operation of the valve train, a lash-free and extremely rigid support of the moments of the adjusting shaft is required. This support governs the positioning precision and the operation of a fully variable valve train as also the adjustability of an internal combustion engine equipped with such a system. The time for adjusting from a minimum to a maximum stroke should be less than 300 milliseconds.

The power requirement of the electric drive of the adjusting shaft should not put a too heavy load on the vehicle network. Therefore, small, high-speed electromotors combined with gearboxes having high transmission ratios are desirable.

One conceivable solution is to use worm drives. These, however, have a poor efficiency and are susceptible to wear that in its turn causes lash. In addition, worm drives have a limited range of transmission. It is also conceivable to use hydraulic adjusters similar to camshaft adjusters configured as vane-type adjusting devices or as coarse-thread adjusters. Their operation, however, depends to a large extent on the temperature of the lubricating oil. Besides this, they require an oil pressure that is only existent when the engine is running and their adjusting dynamics and rigidity are low.

A further solution may be rotary drives but these have a low efficiency and a great amount of rotational lash.

OBJECTS OF THE INVENTION

It is an object of the invention to provide a compact actuator for the adjusting shaft of a fully variable mechanical valve train of an internal combustion engine, which actuator should have the highest possible rigidity and possess characteristics of low lash and low friction.

This and other objects and advantages of the invention will become obvious from the following detailed description.

SUMMARY OF THE INVENTION

The invention achieves the above objects by the fact that an actuator for rotating the adjusting shaft comprises an adjusting lever that is connected rotationally fast to the adjusting shaft, and a free end of the adjusting lever is articulated on the screw nut of a screw-and-nut drive that is driven by an electromotor. The connection of the adjusting lever to the adjusting shaft as well as that of the adjusting lever and the screw nut to the threaded screw are substantially free of lash and very rigid. This results in a high positioning precision and, due to low frictional losses, a short adjusting time. Besides this, the actuator of the invention is very compact.

In a preferred embodiment of the invention, the electromotor drives the threaded screw but a solution in which a screw nut is driven is also feasible.

In an advantageous embodiment of the invention, the free end of the adjusting lever preferably comprises two fork branches that surround the screw nut with clearance. The fork shape of the adjusting lever permits the adjusting lever and the screw nut to be loaded symmetrically with a load that is free of bending moments. In contrast to one-sided loading by a simple adjusting lever, whose use is also conceivable, symmetric loading results in a higher rigidity. A further advantage is that the fork-shaped adjusting lever serves as an optimal securing device against rotation of the screw nut.

The arc-shaped movement of the free end of the adjusting lever and the linear movement of the screw nut necessitate a compensation of movement. This is achieved by the fact that the fork branches comprise opposing slots extending in longitudinal direction of the adjusting lever, and sliding blocks pivotally connected to the screw nut through bearing pins engage into the slots with clearance, said bearing pins having a common axis that extends through the center and the longitudinal axis of the screw nut.

Due to the fact that an electromotor shaft and the threaded screw are made together in one piece, no coupling is required between the electromotor and the threaded screw. Due to the relatively low lateral force exerted by the sliding blocks, no separate mounting arrangement is required for the threaded screw but only a fixed and a movable bearing for mounting the electromotor shaft. This simplifies the design of the actuator and gives it a compact structure while raising its rigidity.

The fixed bearing is configured as a deep groove or an angular contact ball bearing, or as a four-point bearing, while the movable bearing is configured as a needle roller bearing. Advantageously, the screw drive is preferably configured as a ball screw drive with pre-stress and ball deflection and is arranged on the side of the screw nut that is free of shearing forces. The low friction obtained with the balls permits the use of electromotors with a relatively low torque and despite high speeds of adjustment, the load on the vehicle network is only insignificant.

The low lash of the actuator resulting from the pre-stress is a basic requirement for a precise positioning of the adjusting shaft and, thus also, for an exact setting of the valve stroke.

The pre-stressing of the screw can be effected, for example, by an overdimensioning of the balls or, in multipiece screw nuts, by pre-stressing the threaded parts of the nuts. In addition to a ball screw drive, a configuration as a roller screw drive is also possible.

The ball deflection arranged on the side of the screw nut that is free of shearing forces effects a trouble-free return of the balls.

Due to the fact that the transmission ratio between the electromotor and the adjusting shaft can be defined by the length of the adjusting lever and the pitch of the threaded screw, a transmission ratio between 50 and 500:1 can be realized in a single stage. The efficiency values that can thus be achieved are distinctly higher than with multi-stage rotary drives or with worm drives.

A further advantage of the invention is that the actuator can be installed in any longitudinal and any angular position on the adjusting shaft. In this way, the position of the actuator can be optimally adapted to the conditions of installation of the internal combustion engine.

Further features of the invention are disclosed in the following description and in the appended drawings which show a schematic representation of one example of embodiment of the invention.

DETAILED DESCRIPTION OF THE DRAWINGS

Figure 1:
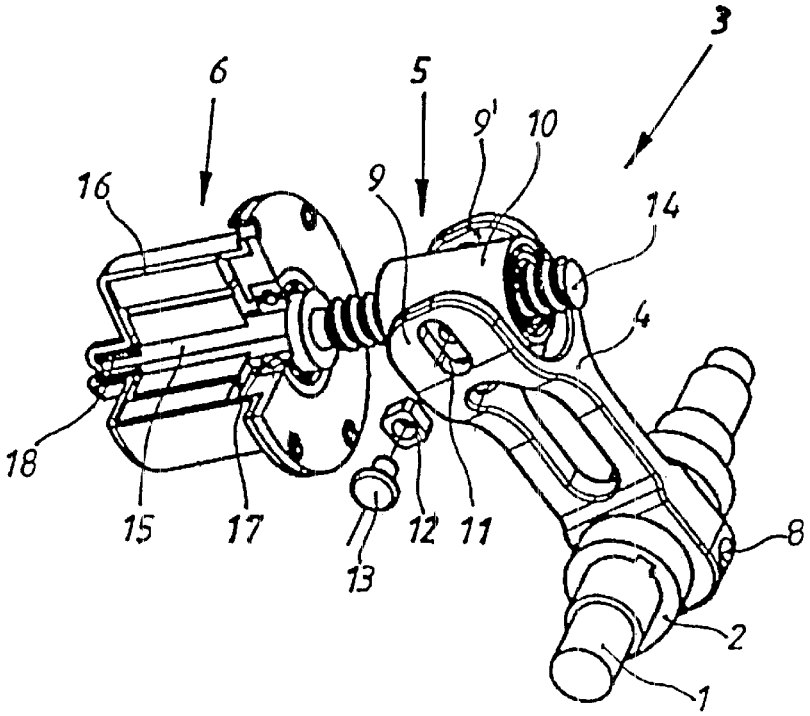
FIG. 1 is a perspective view of an adjusting shaft assembled with an actuator.

FIG. 1 shows an adjusting shaft 1 with an adjusting cam 2 for a fully variable, mechanical valve train, not shown, for an inlet valve of an Otto engine, and an actuator 3 for the adjusting shaft 1.

The actuator 3 comprises an adjusting lever 4, a screw-and-nut drive 5 and an electromotor 6.

The adjusting lever 4 is connected rotationally fast to the adjusting shaft 1. Positive engagement or force-locked shaft-hub connections can be used for this purpose. In the present case, this is achieved by an interference fit using a clamping slot 7 (see FIG. 2) and a clamping screw 8.

The free end of the adjusting lever 4 is configured as a fork with two fork branches 9, 9' that surround a screw nut 10 with clearance. Opposing slots 11 directed toward the adjusting shaft 1 are arranged in the fork branches 9, 9' and serve to guide sliding blocks 12.

The sliding blocks 12 are pivotally connected to the screw nut 10 by bearing pins 13. The bearing pins 13 have a common axis that extends through the center and the longitudinal axis of the screw nut 10. The screw nut 10 and a threaded screw 14 constitute the screw-and-nut drive 5. The screw nut 10 is secured against rotation by the adjusting lever 4.

The threaded screw 14 and an electromotor shaft 15 are made together in one piece. Therefore no coupling between these two components and no separate mounting for the threaded screw 14 are required. This results in a compact, rigid and simple structure of the actuator 3.

The electromotor shaft 15 is mounted in the housing 16 of the electromotor 6 in a fixed bearing 17 and a movable bearing 18. The fixed bearing 17 that also supports the thrust forces is configured as a deep groove ball bearing, while the movable bearing 18 that supports only radial forces is configured as a needle roller bearing. The housing 16 is arranged in the cylinder head 19 (see FIG. 3).

Figure 2:
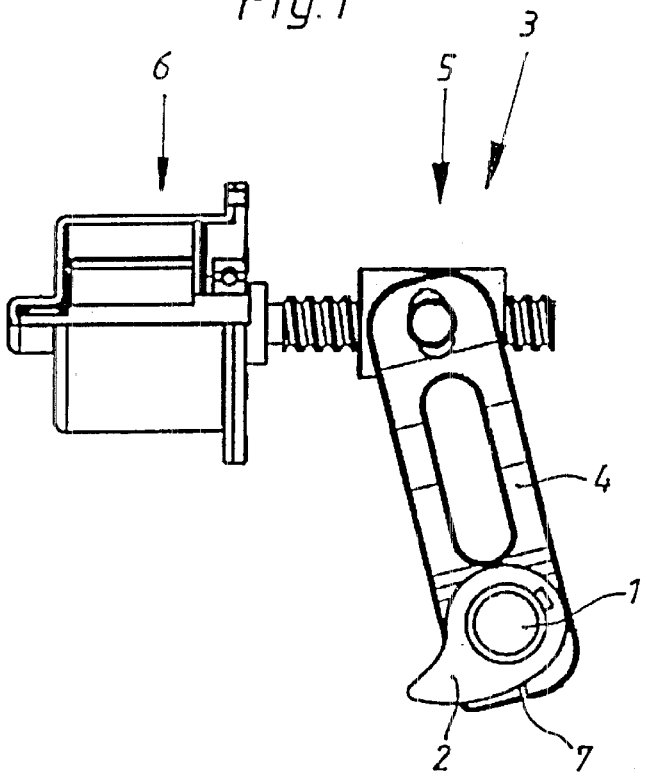
FIG. 2 is a side view of the actuator of FIG. 1.

The side view of FIG. 2 shows the adjusting shaft 1 with the adjusting cam 2 and the actuator 3 with the electromotor 6, the screw-and-nut drive 5 and the adjusting lever 4.

Figure 3:
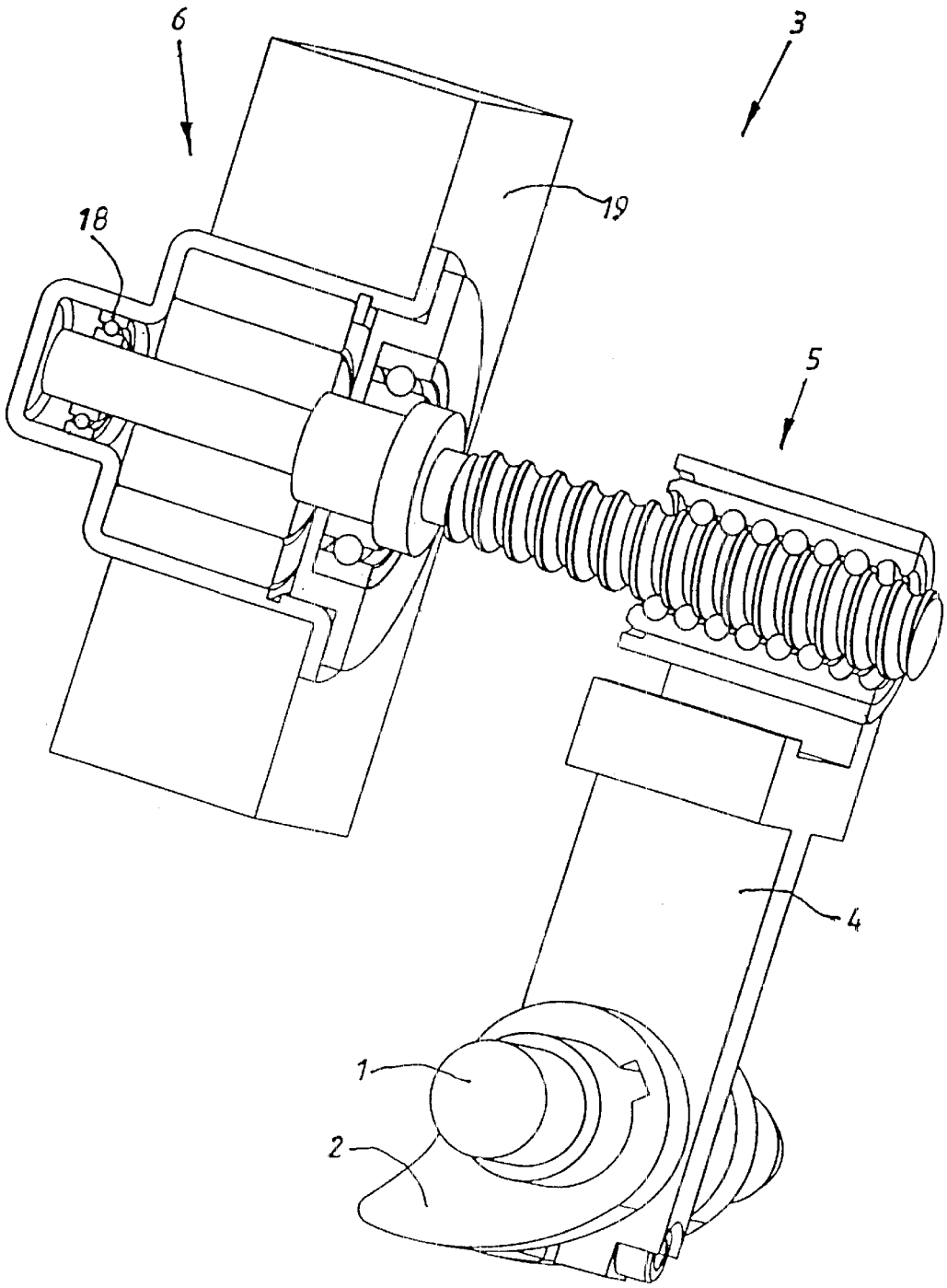
FIG. 3 is a perspective view of the actuator of FIG. 1, the screw-and-nut drive, however, being shown in section.

In FIG. 3, the adjusting shaft 1 with the adjusting cam 2 and the actuator 3 are shown partly in perspective and partly in section. The screw-and-nut drive 5 is configured as a ball screw drive which distinguishes itself by low frictional losses. This permits the use of a low-torque electromotor 6 that does not significantly load the vehicle network. The electromotor 6 is shown in FIG. 3 in the installed state in the cylinder head 19. The movable bearing 18 is configured as a deep groove ball bearing.

The actuator 3 of the invention functions as follows:

The threaded screw 14 that is firmly connected to the electromotor shaft 15 is driven by the electromotor 6. Since the screw nut 10 is secured against rotation by the fork-shaped adjusting lever 4, the rotation of the threaded screw 14 is converted into a translational movement of the screw nut 10. The movement of the screw nut 10 is transmitted through the bearing pins 13 and the sliding blocks 12 to the adjusting lever 4 and leads to a pivoting of the adjusting lever 4 and to a rotation of the adjusting shaft 1. By this, the desired stroke adjustment of the inlet valve is effected through the adjusting cam 2.

The actuator 3 of the invention distinguishes itself by high rigidity, low frictional losses and a compact structure. Besides this, it is flexible with regard to the transmission ratio and installing position. The transmission ratio between the electromotor 6 and the adjusting shaft 1 can be varied in a single stage in the range of 50 to 500:1 by an appropriate choice of the length of the adjusting lever 4 and the pitch of the threaded screw 14. The actuator can be installed at any desired point on the adjusting shaft 1 and in any desired angular position relative thereto. Its freedom from lash permits a high positioning precision and its low friction enables a high speed of adjustment.

What is claimed is:

1. An electrically rotatable adjusting shaft of a fully adjusting shaft of a fully variable mechanical valve train of an internal combustion engine, said shaft comprising an adjusting cam, wherein an actuator that rotates the adjusting shaft comprises an adjusting lever that is connected rotationally fast to the adjusting shaft, and a free end of the adjusting lever is articulated on a screw nut of a screw-and-nut drive that is driven by an electromotor, the free end of the adjusting lever comprises two fork branches that surround the screw nut with clearance.

2. An electrically rotatable shaft of claim 1 wherein the fork branches comprise opposing slots extending in longitudinal direction of the adjusting lever, into which slots, sliding blocks that are pivotally connected to the screw nut through bearing pins engage with clearance.

3. An electrically rotatable shaft of claim 2, wherein the bearing pins have a common axis that extends through a center and through a longitudinal axis of the screw nut.

4. An electrically rotatable shaft of claim 3, wherein an electromotor shaft and a threaded screw are made together in one piece.

5. An electrically rotatable shaft of claim 4 wherein the electromotor shaft comprises a fixed bearing and a movable bearing.

6. An electrically rotatable shaft of claim 5, wherein the fixed bearing is configured as one of a deep groove ball bearing, an angular contact ball bearing and a four point bearing, while the movable bearing is configured as a needle roller bearing.

7. An electrically rotatable shaft of claim 6, wherein the screw-and-nut drive is configured as a ball screw drive with pre-stress and ball deflection and is arranged on a side of the screw nut that is free of shearing forces.

8. An electrically rotatable shaft of claim 7, wherein a transmission ratio between the electromotor and the adjusting shaft can be defined by a length of the adjusting lever and a pitch of the threaded screw.

9. An electrically rotatable shaft of claim 8, wherein the actuator can be installed in any longitudinal and any desired angular position on the adjusting shaft.

* * * * *